United States Patent [19]

Houbolt

[11] 3,978,845

[45] Sept. 7, 1976

[54] BURNER IDENTIFICATION DEVICE FOR KITCHEN RANGES

[75] Inventor: Neal Houbolt, Joliet, Ill.

[73] Assignee: Jemco Engineering Co., Minooka, Ill.

[22] Filed: Sept. 11, 1975

[21] Appl. No.: 612,349

[52] U.S. Cl. ..... 126/39 R; 431/13

[51] Int. Cl.[2] ..... F24C 3/00

[58] Field of Search ..... 126/39 R, 39 E, 211, 126/214 A; 431/13, 14, 17

[56] References Cited

UNITED STATES PATENTS

| | | | |
|---|---|---|---|
| 3,194,945 | 7/1965 | Barmett | 126/214 A |
| 3,529,584 | 9/1970 | Celaya | 431/13 X |
| 3,711,672 | 1/1973 | Moreland et al. | 126/211 X |

*Primary Examiner*—Edward G. Favors

*Attorney, Agent, or Firm*—Allegretti, Newitt, Witcoff & McAndrews

[57] ABSTRACT

A kitchen range burner indicator. The burner indicator is mountable on the control panel of the kitchen range to correlate the burner elements and respective controls. The indicators are interchangeable, without forfeiture of the burner-control correlation.

11 Claims, 7 Drawing Figures

BURNER IDENTIFICATION DEVICE FOR KITCHEN RANGES

BACKGROUND OF THE INVENTION

The present invention relates generally to an indicator and more particularly to an apparatus for indicating the correlation or correspondence between the burners and controls of a kitchen range.

The presently known kitchen ranges include a series of burners and corresponding controls. Correlation between the burners and controls is usually indicated on the actuating or control knob. For example, initials, such as "LF" indicating the front-left burner, are embossed on the control knob.

The control knobs are, however, interchangeable between the controls, such that the burner-control correlation can be confused or destroyed. Lack of correlation creates an obviously dangerous situation, particularly with respect to the recently developed ceramic top ranges wherein an activated burner is substantially indistinguishable.

Additionally, the use of initials, such as "LF", whether on the control knob or a plate adjacent the control knob, offer no assistance to a non-English speaking user. In this situation, correlation between the burners and controls must be committed to memory, thereby introducing human error into the selection of a burner element.

As such, the presently known ranges and burner indicators do not meet safety standards recently promulgated by various agencies, including Underwriter's Laboratory and the American Gas Association. These standards are effective Jan. 1, 1976.

SUMMARY OF THE INVENTION

In a principal aspect, the present invention is an apparatus for indicating the correlation between the burners and controls of a kitchen range. The burner indicator is mountable in an opening adjacent the burner control knob. The apparatus includes a plate member bearing an indicator and a pair of securing prongs extending from the rear face of the plate member.

The burner indicator also includes means for keying the apparatus and opening. The keying means is coordinated with the indicator in a predetermined manner.

It is thus an object of the present invention to provide an apparatus for indicating the burner-control relationship of a kitchen range of any type.

It is another object of the present invention to provide a burner indicator for use with a kitchen range, whereby the correlation between the control and burner is maintained, despite interchangeability of the burner indicators.

It is also an object of the present invention to provide a burner indicator which is readily detachable from the control panel of a kitchen range, thereby facilitating cleaning of the kitchen range.

It is also an object of the present invention to provide a burner indicator for a kitchen range which is readily and inexpensively manufactured.

These and other objects, features and advantages of the present invention will become apparent in the following detailed description.

BRIEF DESCRIPTION OF THE DRAWING

A preferred embodiment of the present invention will be described, in detail, with reference to the drawing wherein.

DESCRIPTION OF A PREFERRED EMBODIMENT

Figure 1:
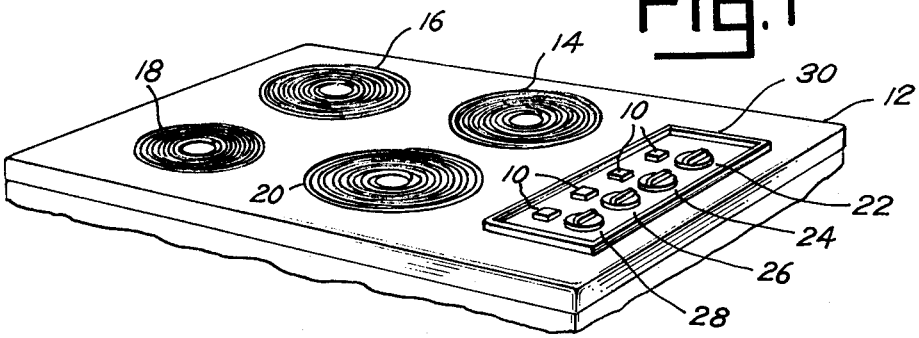
FIG. 1 is a partial perspective view of a kitchen range including and incorporating a preferred embodiment of the present invention.
Figure 2:
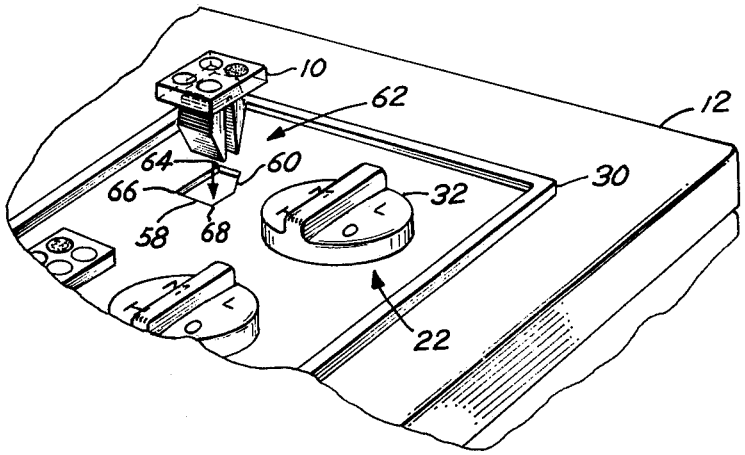
FIG. 2 is a partial, exploded view of the kitchen range and preferred embodiment shown in FIG. 1.
Figure 3:
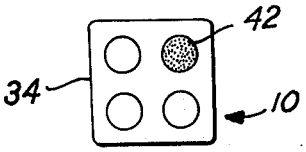
FIG. 3 is a front view of the preferred embodiment shown in FIG. 2.

Referring to FIGS. 1 and 2, a preferred embodiment of the present invention is shown as a burner indicator 10, incorporated in a kitchen range 12. For purposes of illustration alone, the kitchen range 12 is an electric range having four (4) burner elements 14, 16, 18, 20 and four (4) controls, generally designated 22, 24, 26, 28. It is to be understood that the present invention is equally compatible with any other type of range, including any number of burner elements.

The controls 22, 24, 26, 28 regulate the heat produced by the burner elements 14, 16, 18, 20, respectively. In this preferred embodiment, the controls 22, 24, 26, 28 particularly regulate the amount of current supplied to the burner elements 14, 16, 18, 20. The controls 22, 24, 26, 28 are substantially identical and each is associated with one of the burner indicators 10. For clarity, the following description is generally limited to the control 22, best shown in FIG. 2.

The contol 22 is situated within a control panel 30 and includes an actuating or control knob 32. The burner indicator 10 associated with the control 22 is adjacent the control knob 32 on the control panel 30. The control 22 has four (4) operative states, i.e., off, low, medium and high as indicated by the initials "O", "L", "M" and "H" on the control knob 32.

Figure 6:
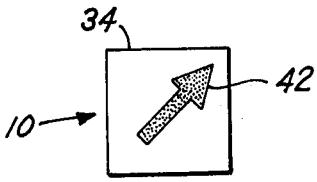
FIGS. 6 and 7 are front views of alternative embodiments of the present invention.
Figure 7:
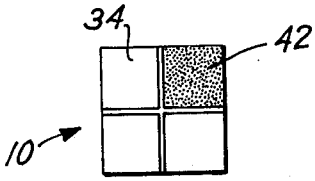

Referring now to FIGS. 2–5, the burner indicator 10 includes a plate member 34 and a pair of securing prongs 36, 37. The plate member 34 has a front and rear face 38, 40, respectively. The front face 38 includes an indicator 42, shown in FIG. 3 as a circular dot in the upper right quadrant or corner of the front face 38. Various other indicators are shown in FIGS. 6 and 7.

The indicator 42 identifies the correlation between the control 22 and burners 14, 16, 18, 20. That is, the indicator 42 pictorially indicates and reveals that the control 22 regulates the burner element 14. More particularly, the quadrants of the front face 38 of the plate member 34 correspond to the burners 14, 16, 18, 20. In a range having only two (2) burner elements, side-by-side, the front face 38 would be divided into corresponding halves.

The securing prongs 36, 37 are rigidly attached to the rear face 40 of the plate member 34 and extend therefrom. The prongs 36, 37 include a tapered end section 44 and a toothed section 46, having a series of serrations or teeth, generally designated 48. The toothed section 46 interposes the plate member 34 and tapered end section 44, joining the tapered end section 44 at a junction 50.

Figure 4:
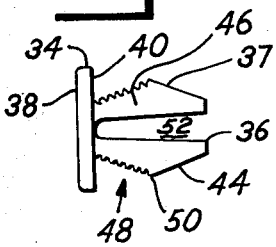
FIG. 4 is a side view of the preferred embodiment shown in FIG. 3.

As shown in FIG. 4, the sections 44, 46 define, in longitudinal cross-section, a substantially triangular prong. The prongs 36, 37 define a substantially U-shaped channel 52. The tapered end section 44 inclines downwardly from the junction 50 towards the channel 52. The toothed section 46 also inclines towards the channel 52 from the junction 50.

Figure 5:
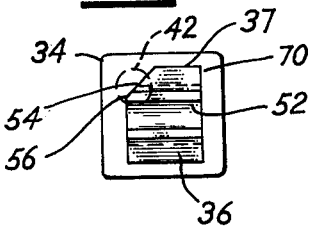
FIG. 5 is a back view of the preferred embodiment shown in FIG. 3.

Referring to FIG. 5, the prong 37 includes a keying surface 54. In this preferred embodiment of the present invention, the keying surface 54 is substantially planar and defined by truncation of a side 56 of the prong 37.

The indicator 42 and keying surface 54 are coordinated in a predetermined manner. In this preferred embodiment, the indicator 42 and keying surface 54 substantially longitudinally aligned, as shown in FIG. 5.

Referring again to FIG. 2, the control panel 30 includes an opening 58 adapted to receive the burner indicator 10. As shown, the opening 58 has a truncated corner 60, corresponding to the truncated side of the prong 37. Referring to FIGS. 2 and 5, the perimeter generally defined by the prongs 36, 37 and opening 58 is elongated and substantially rectangular.

In this preferred embodiment of the present invention, the keying surface 54 and truncated corner 60 cooperatively define means, generally designated 62, for keying the burner indicator 10 and opening 58. That is, the burner indicator 10 is insertable only at a predetermined orientation with respect to the opening 58, and once inserted, rotation of the burner indicator 10 is substantially avoided. It is to be understood, however, that any configuration of the burner indicator 10 and opening 58 providing the keyed relationship may be utilized. The truncated corner 60 of the openings 58 corresponding and adjacent to the controls 24, 26, 28 is positioned at the corners 64, 66, 68, respectively, shown in FIG. 2.

Due to the generally elongated perimeter of the prongs 36, 37 and openings 58, the burner indicators 10 for the controls 22, 26 are substantially identical. Similarly, the burner indicators 10 for the controls 24, 28 are substantially identical. With reference to FIG. 5, the keying surface 54 of the burner indicator 10 for the controls 24, 28 is positioned at the side 70, as opposed to the side 56.

The burner indicators 10 for the controls 22, 26 and 24, 28 are interchangeable, respectively, without forfeiture of the burner-control correlation. That is, the burner indicator 10 initially installed adjacent the control 22 may be removed, rotated and inserted adjacent the control 26, maintaining proper identification of the burner 18 as the element regulated by the control 26. Substantially square or round perimeters, with appropriate keying, would create total interchangeability without forfeiture of the burner-control correlation. As such, the burner indicator 10 substantially meets the safety requirements, discussed above.

The burner indicator 10 is preferably injection molded nylon, such that the prongs 36, 37 are flexible. The flexibility and tapered end sections 44 of the prongs 36, 37 facilitate insertion of the burner indicator 10 into the opening 58. Once inserted, the burner indicator 10 is maintained by the toothed section 46, as the prongs 36, 37 flex towards a relaxed state.

The indicator 42 is stamped upon the front face 38 of the plate member 34 in a readily visible and contrasting color, such as red on a white background. Two-color molding can also be utilized.

A single preferred embodiment of the present invention has been disclosed herein. It is to be understood, however, that various changes and modifications can be made without departing from the true scope and spirit of the present invention as set forth and defined in the following claims.

What is claimed is:

1. An apparatus mountable in an opening comprising, in combination:

a plate member having a front face, a rear face and an indicator on said front face;

a pair of securing prongs attached to said rear face and extending therefrom, said securing prong including a tapered end section and a toothed section interposed said plate member and said tapered end section; and means for keying said apparatus and said opening, whereby said pair of prongs is insertable into said opening at substantially only a predetermined orientation with respect to said openings, said indicator and said keying means having a determined coordinated relationship.

2. An apparatus as claimed in claim 1 wherein said securing prongs are flexible to facilitate insertion into said opening.

3. An apparatus as claimed in claim 1 wherein at least one of said securing prongs includes a keying surface, said keying surface and said opening cooperatively defining said keying means.

4. An apparatus as claimed in claim 1 wherein said plate member and said pair of securing prongs are integral.

5. An apparatus as claimed in claim 4 wherein said apparatus is nylon.

6. An apparatus for indicating the correlation between burners and controls on a kitchen range, said kitchen range having an opening adapted to receive said apparatus, comprising, in combination:

a plate member having a front face, rear face and an indicator on said front face; and a pair of flexible securing prongs rigidly secured to said rear face of said plate member and extending therefrom, at least one of said flexible securing prongs having means for keying said apparatus and opening, said keying means and said indicator having a predetermined coordinated relationship.

7. An apparatus as claimed in claim 6 wherein said flexible securing prong has a tapered end section to facilitate insertion into said opening.

8. An apparatus as claimed in claim 7 wherein said flexible securing prong further includes a toothed section interposed said plate member and said tapered end section to substantially maintain said apparatus in said opening.

9. An apparatus as claimed in claim 6 wherein said one of said flexible securing prongs includes a truncated side, said opening having a corresponding truncated corner, said truncated side and corner cooperatively defining said keying means.

10. An apparatus as claimed in claim 6 wherein said plate member and said pair of flexible securing prongs are integral.

11. An apparatus as claimed in claim 10 wherein said apparatus is molded nylon.

* * * * *